US009687067B2

(12) United States Patent
Calman et al.

(10) Patent No.: US 9,687,067 B2
(45) Date of Patent: Jun. 27, 2017

(54) MAGNETIC ATTACHMENT ASSEMBLY

(71) Applicant: Geek Wraps, Inc., Oakland Park, FL (US)

(72) Inventors: Kenneth J. Calman, Fort Lauderdale, FL (US); Kathryn S. Calman, Fort Lauderdale, FL (US)

( * ) Notice: Subject to any disclaimer, the term of this patent is extended or adjusted under 35 U.S.C. 154(b) by 1 day.

(21) Appl. No.: 14/330,362

(22) Filed: Jul. 14, 2014

(65) Prior Publication Data

US 2015/0013113 A1 Jan. 15, 2015

Related U.S. Application Data

(60) Provisional application No. 61/957,912, filed on Jul. 13, 2013.

(51) Int. Cl.

| | |
|---|---|
| ***A45F 5/02*** | (2006.01) |
| ***A45C 11/36*** | (2006.01) |
| ***A45C 13/10*** | (2006.01) |
| ***H01F 7/02*** | (2006.01) |

(52) U.S. Cl.

CPC ..... *A45F 5/021* (2013.01); *A45C 11/36* (2013.01); *A45C 13/1069* (2013.01); *H01F 7/0252* (2013.01); *A45F 2200/0566* (2013.01); *A45F 2200/0575* (2013.01); *Y10T 24/13* (2015.01); *Y10T 24/32* (2015.01)

(58) Field of Classification Search

CPC ..... A45F 5/021; A45F 2003/144; A45F 2200/0566; A45F 2200/0575; A45C 11/36; A45C 13/1069; Y10T 24/13; Y10T 24/32; H01F 1/117; H01F 7/0215; H01F 7/0252

USPC ..... 224/183, 677

See application file for complete search history.

(56) References Cited

U.S. PATENT DOCUMENTS

| | | | | | |
|---|---|---|---|---|---|
| 4,308,155 | A * | 12/1981 | Tada | H01F 1/117 | 106/459 |
| 4,408,706 | A * | 10/1983 | Hurley | B26B 29/025 | 224/192 |
| 5,201,448 | A * | 4/1993 | Schue | 224/675 | |
| D350,849 | S * | 9/1994 | Dancyger | D3/228 | |
| 2009/0289090 | A1 * | 11/2009 | Fullerton et al. | 224/183 | |

* cited by examiner

*Primary Examiner* — Corey Skurdal
(74) *Attorney, Agent, or Firm* — Ice Miller LLP

(57) ABSTRACT

An attachment assembly comprises a removable member and an attachment member. The removable member comprises a first coupling member and the attachment member comprises a second coupling member. At least one of the first coupling member and the second coupling member comprises a ferromagnetic material such that the first coupling member magnetically couples to the second coupling member.

20 Claims, 4 Drawing Sheets

MAGNETIC ATTACHMENT ASSEMBLY

RELATED APPLICATION DATA

This application claims priority benefit of U.S. Provisional Application No. 61/957,912 filed Jul. 13, 2013, which is hereby incorporated in its entirety herein by reference.

FIELD OF THE INVENTION

The present invention relates to attachment assemblies and, in particular, to magnetic attachment assemblies.

BACKGROUND OF THE INVENTION

Craftsmen in industries such as the vehicle wrap, automotive paint protection, automotive bed liner, home décor, automotive sign and graphics, woodworking, and construction industries, as well as any industry professional that uses small tools during the performance of his or her job, require easy and efficient access to the tools of their trade. Particularly in the adhesive wrap industry, a graphics installer applies adhesive sheet materials or tape to the exterior of a vehicle, watercraft, aircraft, or any other surface to be covered. A variety of tools and supplies are utilized to apply the adhesive sheet materials or tape including squeegees of varying size, type, or function, levels, tape measures, screw drivers, wrenches, nails, pencils, knives, razors, scissors, and tape reels. The graphics installer must move to various stations or locations of the vehicle or surface, including locations that are very low to the ground or that have very little space for installer movement. Conventional tool belts or other holders are too bulky to be utilized in the tight spaces in which graphics installers must operate. Further, conventional holders are not easily removed in such tight spaces and installers cannot reposition or easily reattach the conventional holders as installation moves to different areas of the work surface.

Therefore, there remains a need for an attachable holder assembly that is quickly and easily removed. Further, there remains a need for an attachment assembly that is capable of being reattached at another location, such as a vehicle surface, to allow installers to access necessary tools for completion of the adhesive wrap work.

SUMMARY OF THE INVENTION

In accordance with an aspect of the invention, an attachment assembly is provided comprising a holding member and an attachment member, wherein the holding member comprises a main portion and an upper portion, the main portion having a substantially planar body and at least one holding space defined by an outer portion coupled to the main portion at two or more separate locations of the main portion, and the upper portion having a first coupling member; and wherein the attachment member comprises a second coupling member, and wherein at least one of the first coupling member and the second coupling member comprises a ferromagnetic material such that the first coupling member magnetically couples to the second coupling member.

The attachment member may further comprise a first side and a second side opposite the first side such that the second side faces a person attached to the attachment member. The attachment member may comprise a belt to be worn by a person attached to the attachment member. The attachment member may further comprise a first side portion and a second side portion opposite the first side portion cooperating with the first side portion in fixing the attachment member to a person. The first side portion and the second side portion may cooperate to fix the attachment member to a belt. The substantially planar body may comprise a flexible body. The main portion may extend below the attachment member. At least one holding space may comprise a plurality of holding spaces defined by an outer portion coupled to the main portion at three or more separate locations of the main portion. At least one holding space of the plurality of holding spaces may comprise a pocket having an open upper end and a closed lower end. At least one holding space of the plurality of holding spaces may comprise a loop having an open upper end and an open lower end. Each of the first coupling member and the second coupling member may comprise a plurality of magnets. The plurality of magnets in at least one of the first coupling member and the second coupling member may be arranged in a varied polarity array such that at least two magnets in the array are positioned with reversed polarity relative to each other.

In accordance with further aspects of the present invention, an attachment assembly is provided comprising a removable member and an attachment member, the removable member comprising a first coupling member comprising a first plurality of magnets positioned in a first array having at least one first magnet in a first polarity configuration and at least one second magnet in a second polarity configuration, and the attachment member comprising a second coupling member comprising a second plurality of magnets positioned in a second array having at least one third magnet in a second polarity configuration and at least one fourth magnet in a first polarity configuration such that each of the first plurality of magnets positioned in the first array are attracted to each correspondingly positioned magnet of the second plurality of magnets positioned in the second array.

The first coupling member may be disposed at an inner side of the removable member. The second coupling member may be disposed at an outer side of attachment assembly. The attachment assembly may comprise an inner side configured to face an attachment assembly user. The attachment assembly may comprise a belt to be worn by the attachment assembly user. The attachment assembly may comprise a sleeve having an open first end and an open second end for fixing the attachment assembly to a belt. The removable member may comprise a main portion and an upper portion, the main portion having a substantially planar body and at least one holding space defined by an outer portion coupled to the main portion at two or more separate locations of the main portion. The main portion may comprise at least two holding spaces defined by the outer portion coupled to the main portion at three or more separate locations of the main portion.

BRIEF DESCRIPTION OF THE FIGURES

While the specification concludes with claims particularly pointing out and distinctly claiming the present invention, the present invention will be better understood from the following description in conjunction with the accompanying Drawing Figures, in which like reference numerals identify like elements, and wherein:

DETAILED DESCRIPTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
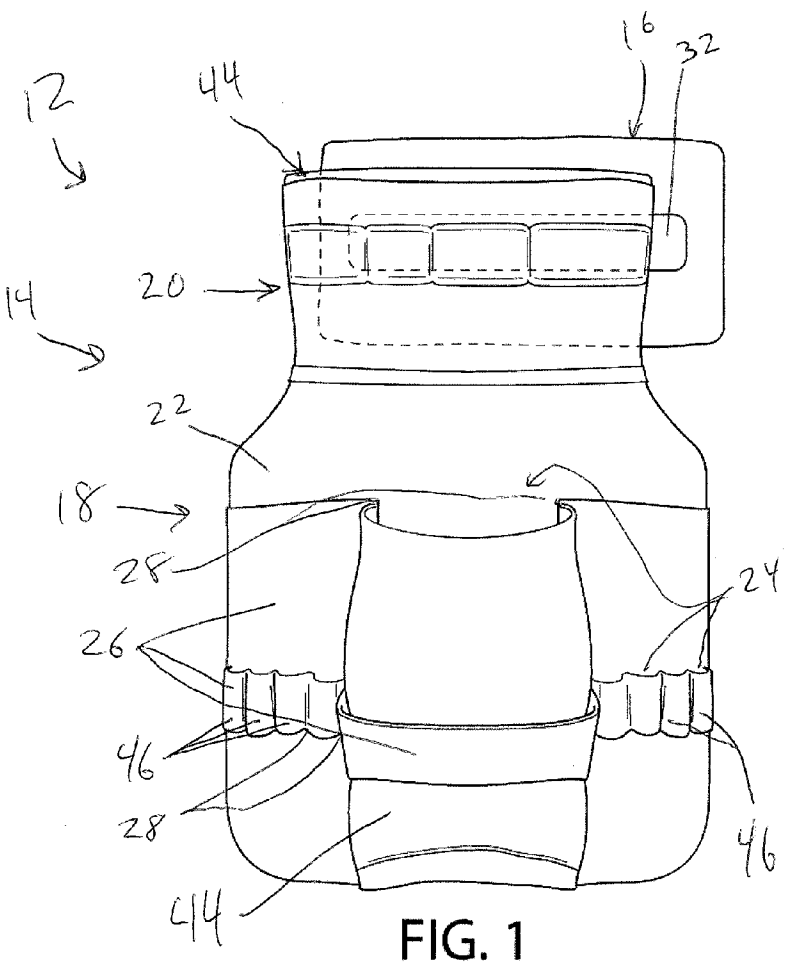
FIG. 1 is a front perspective view of a holding member or removable member of an attachment assembly in accordance with aspects of the present invention.

Reference is now made to FIG. 1, which shows an attachment assembly 12 in accordance with a preferred embodiment of the present invention. The attachment assembly 12 shown in FIG. 1 includes a holding member 14, also referred to herein as a removable member 14, and an attachment member 16. The holding member 14 includes a main portion 18 having a body 22 that is substantially planar as shown in FIG. 1 and further shown in FIG. 2, extending downward from an upper portion 20 of the holding member 14. In the preferred embodiment shown in FIG. 1, the core of the upper portion 20, the main portion 18, and the body 22 is comprised of saddle leather to permit flexibility while remaining durable. At an outer portion 26 of the body 22 or main portion 18, one or more pockets 44, also referred to herein as pouches, or loops 46 are positioned as holding spaces 24 for a variety of tools, supplies, or other objects. The embodiment of FIG. 1 shows one large central pocket 44 formed from a polypropylene material by stitching, attaching, or other coupling at two ends to the body 22 with a closed lower end to retain, hold, or store objects, such as tools or supplies. Several loops 46 are formed on both sides of the pocket 44 by one or more strips of elastic material that is stitched, attached, or otherwise coupled to the body 22 at several coupling locations, as shown in FIG. 1. The elastic material allows the loops 46, which have an open upper end and open lower end, to securely retain or hold a variety of smaller tools or objects. The preferred embodiment of the present invention further includes multiple loops 46 at the upper portion 20 with a pocket 44 formed at the top edge of the holding member 14.

Figure 4:
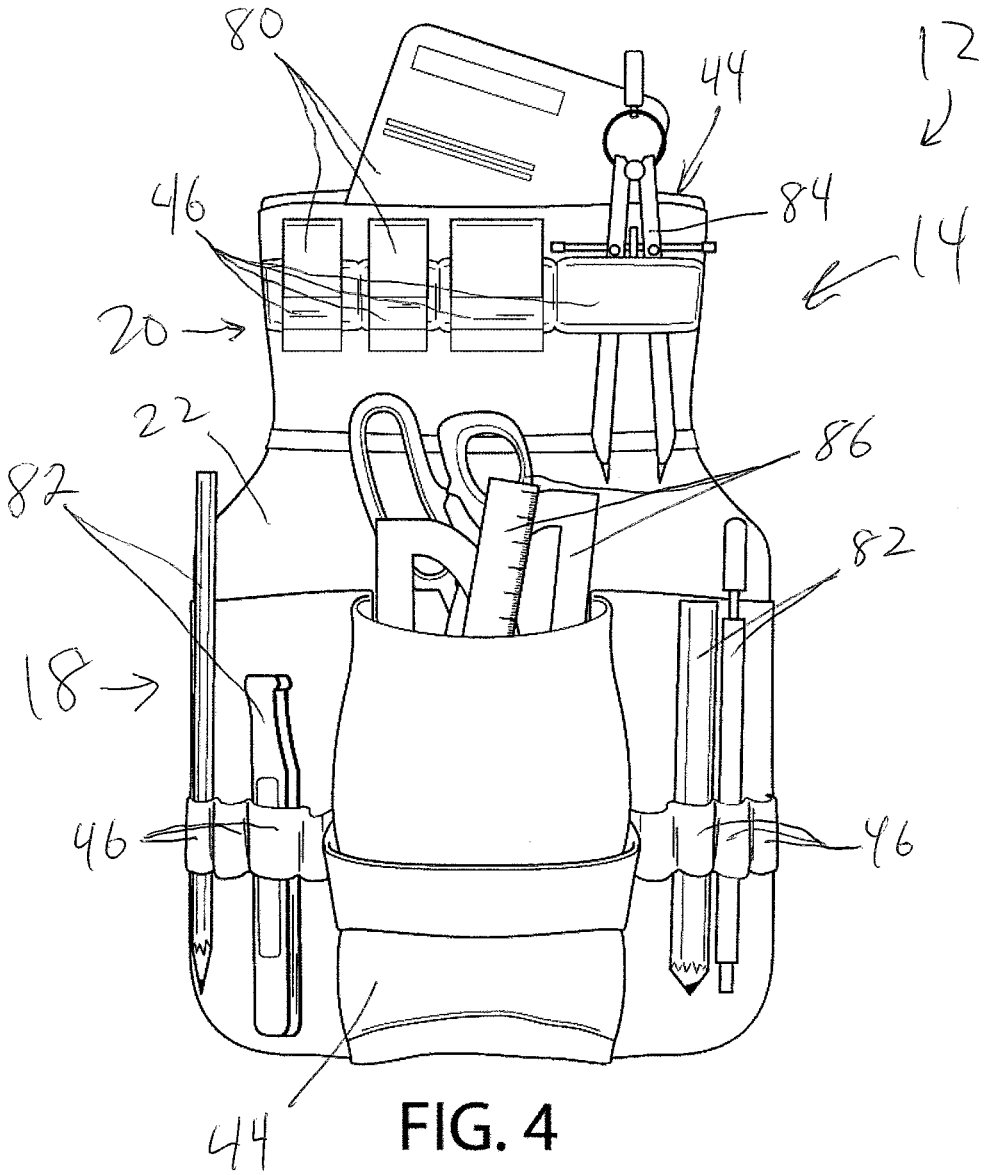
FIG. 4 is a front perspective view of a holding member or removable member of an attachment assembly in accordance with aspects of the present invention.

Referring now to FIG. 4, the holding member 14 is shown storing, retaining, or holding a variety of objects. The pocket 44 at the main portion 18 is large enough to accommodate uniquely shaped or sized objects 86, such as scissors, a ruler or other tools. Loops 46 formed on either side of the pocket 44 at the main portion are elastic to releasably secure objects 82 such as pencils, knives, tweezers, or other similar tools. At the upper portion 20, the pocket 44 can hold, store, retain, or otherwise support objects such as a squeegee 80. Additionally, a series of loops 46 at the upper portion 20 supports smaller squeegees 80 or other objects or tools 84 of similar size or shape, as shown in FIG. 4.

Figure 2:
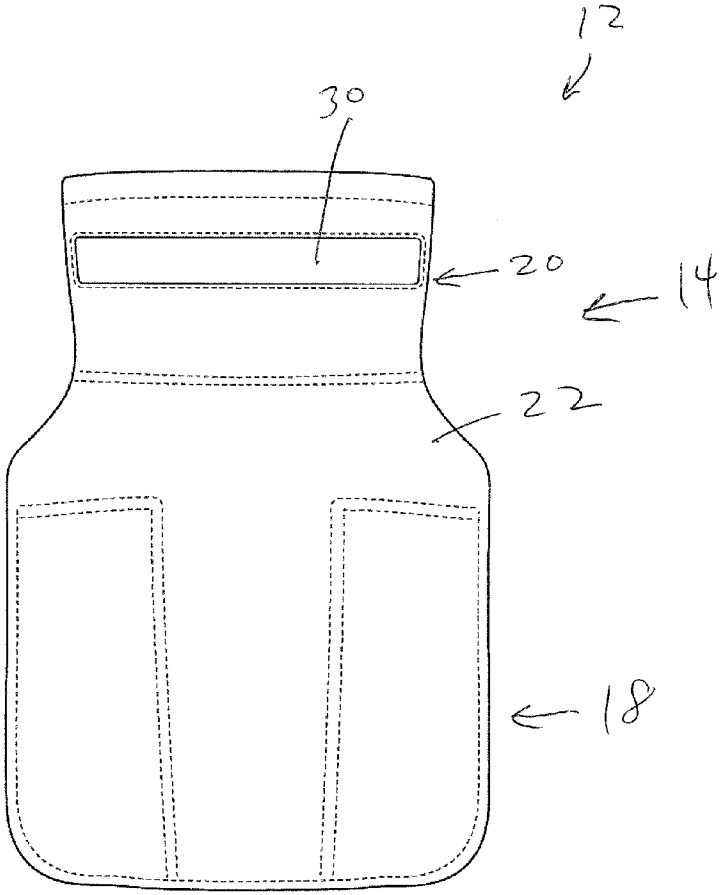
FIG. 2 is a rear perspective view of a holding member or removable member of an attachment assembly in accordance with further aspects of the present invention.

Referring now to FIG. 2, the back side of the holding member 14 of the attachment assembly 12 is shown. At the upper portion 20, a first coupling member 30 includes one or more magnets, which in the preferred embodiment includes a row or array of three magnets that are enclosed within a saddle leather core, shown in further detail in FIG. 5. The first coupling member 30 attaches, couples, mates, is attracted to, or is otherwise designed to join a second coupling member 32 of the attachment member 16, as shown in FIG. 1.

Figure 3:
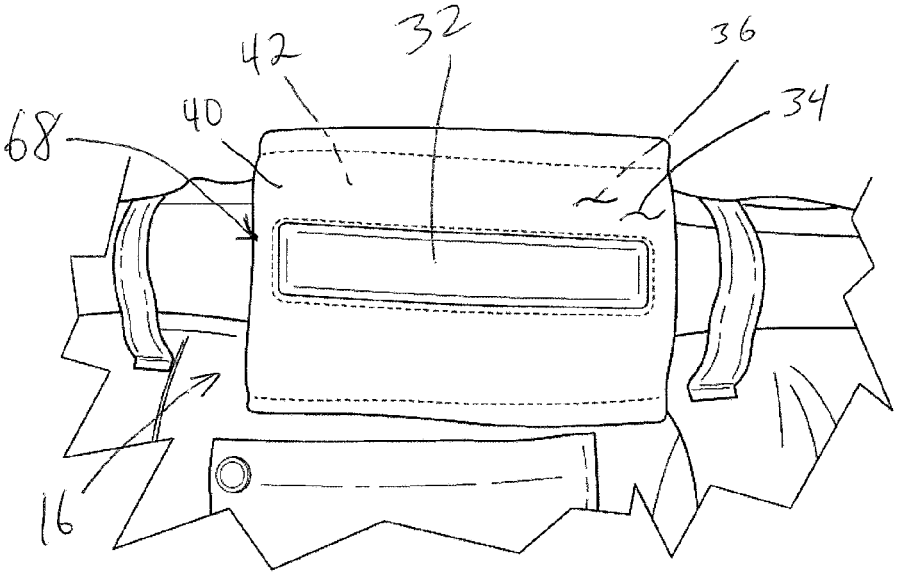
FIG. 3 is a front perspective view of an attachment member of an attachment assembly in accordance with further aspects of the present invention.

Referring now to FIG. 3, one embodiment of the attachment member 16 is shown as a sleeve 68 having a first side portion 40 at an outer side and a second side portion 42, or first side 34 facing outward and a second side 36 facing an inner direction, such as toward a person wearing the attachment member 16. The sleeve 68 of the embodiment shown in FIG. 3 is positioned around a person's belt such that the second coupling member 32 is positioned in an outward-facing direction.

Figure 5:
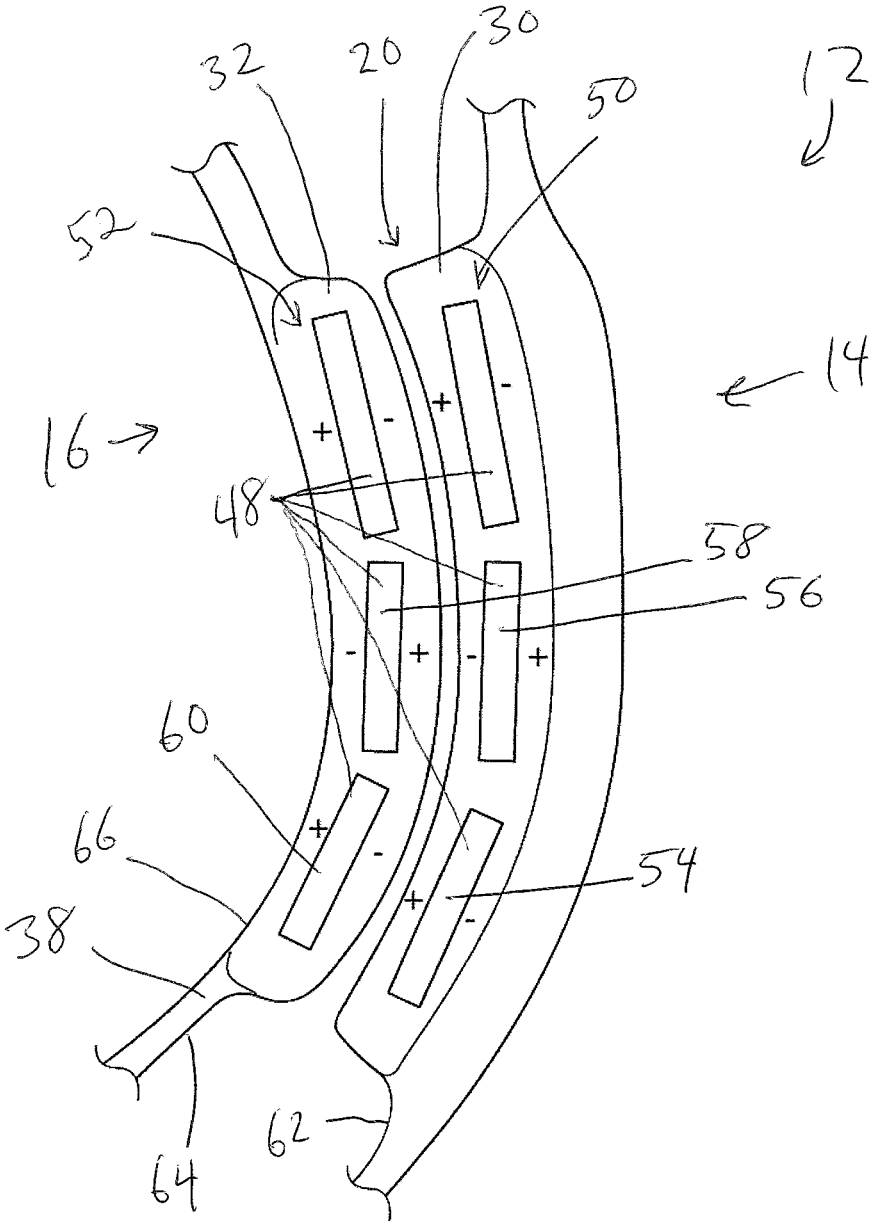
FIG. 5 is an enlarged partial cross-sectional top view of an attachment assembly in accordance with further aspects of the present invention.

An alternative embodiment of the attachment member 16, referenced in FIG. 5, includes the second coupling member 32 being incorporated into a belt 38. Further alternative embodiments may include second coupling member 32 being incorporated into another article of clothing or accessory located on a person's body, such as a shirt sleeve or a pant leg or pocket. These alternative embodiments allow direct attachment of the holding member 14 to a person rather than needing a separate article for attachment.

A craftsman uses the attachment assembly 12 of the preferred embodiment shown in FIGS. 1 and 3 by securing the attachment member 16 to his or her body, typically by threading his or her belt through the attachment member 16 and wearing the belt such that the attachment member 16 faces forward with the second coupling member 32 facing outward. The holding member 14, as shown in FIG. 1, may be initially attached to the craftsman as he or she begins work, offering ease of access to tools, supplies, and other items as needed because of the convenient location. As the work surface or nature of the work requires the craftsman to move frequently to different and often more restrictive areas, the holding member 14 may be quickly detached from the attachment member 16 and reattached to a work piece or surface, such as a metallic vehicle panel, a work bench, or other surface comprised of a ferrous or other material to which the magnet(s) of the first coupling member 30 are capable of attracted. After reattachment, the holding member 14 may be again detached and reattached to a new surface as needed to provide a different, user-preferred method or location of access to the objects of the holding member 14 as the craftsman performs his or her work.

Referring now to FIG. 5, a top view of an embodiment of the attachment assembly 12 is shown. The first coupling member 30 of the holding or removable member 14 of the embodiment shown in FIG. 5 includes three magnets 48 configured in a first array 50. An inner side 62 of the removable member 14 faces the attachment member 16. The attachment member 16 of the embodiment shown in FIG. 5 is a belt 38 or other clothing article or accessory housing the second coupling member 32 having three magnets 48 configured in a second array 52. An inner side of the attachment member 16 faces the person wearing the belt 48 while an outer side 64 faces the removable member 14 such that the polarity of the first array 50 of magnets and the second array 52 of magnets permits attraction between the attachment member 16 and the removable member 14.

As shown in the embodiment of FIG. 5, a first magnet in a first polarity configuration 54 is positioned in the first array 50 adjacent a second magnet in a second polarity configuration 56 different from said first polarity configuration 54.

In the second array 52, a third magnet in the second polarity configuration 58 is positioned adjacent to a fourth magnet in the first polarity configuration 60 such that the first and second magnets 54, 56 are properly attracted to the third and fourth magnets 58, 60.

The particular configuration of each magnet 48 may be varied so long as each of the magnets 48 positioned in the first array 50 is attracted to each correspondingly positioned magnet 48 of the second array 52. As can be expected, there are many possible configurations of mated arrays as determined by the number of magnets 48 in each array. Accordingly, the number of configurations is 2n where n is the number of magnets in each array. In the embodiment shown in FIG. 5, there are eight configurations. However, any number of magnets may be used to increase or decrease the number of potential configurations, and any array shape or design may be used to create the mated first array 50 and second array 52. The variety of polarity configurations allows for customization or organization opportunity as a particular removable member 14 may only properly couple with a correct attachment member 16 due to the unique, matching configuration of the magnets of each. Further, the first coupling member 30 or the second coupling member 32 may not contain magnets, or ferromagnetic materials. If there are one or more magnets 48, in an array or otherwise, incorporated as the first coupling member 30, the second coupling member 32 need only comprise a ferrous or other material to which the magnet(s) are capable of attracted, and vice versa.

In addition to offering a customizable polarity array, the rows or arrays of multiple magnets 48 of the first coupling member 30 and second coupling member 32 offer structural flexibility. Any number of magnets may be incorporated into an array to form a curve or other non-linear or non-planar surface for attachment against a person's body or another surface that is not flat while still being able to hold relatively heavy items. Ferromagnetic materials, such as the strong magnets used in the embodiments described in the present invention, are hard, brittle materials with very little ductility or flexibility. As shown in FIG. 5, the multiple magnets 48 split into individual arrays 50, 52 utilize the large surface area of the entire magnetic array while allowing flexibility with the attachment member 16, such as the belt 38. The belt 38 having the split, segmented, or arrayed magnets 48 of the second coupling member 32 benefits from the ability to bend, flex, or otherwise form around a person's body. In addition to the removable member 14, other items capable of being attracted to the second coupling member 32 may be secured to the attachment member, the belt incorporating magnets 48, or other article incorporating the magnets 48 of the second coupling member 32, such as a dog treat container or a legally concealed weapon. Similarly, the split, segmented, or arrayed magnets 48 of the removable member 14 allow secure coupling to the attachment member 16, as well as to any shape, size, or type of exterior surface, such as the varied geometries of vehicle body panels.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An attachment assembly, comprising:

a holding member and an attachment member;

wherein said holding member comprises a main portion and an upper portion, said main portion having a substantially planar body and at least one holding space defined by an outer portion coupled to said main portion at two or more separate locations of said main portion, and said upper portion having a first coupling member;

wherein said attachment member comprises a sleeve portion having a first side and a second side opposite said first side such that said second side is configured to face an object attached to said attachment member, said sleeve portion including a second coupling member;

wherein at least one of said first coupling member and said second coupling member comprises a ferromagnetic material such that said first coupling member magnetically couples to said second coupling member; and wherein each of said first coupling member and said second coupling member comprises a plurality of magnets, said plurality of magnets in at least one of said first coupling member and said second coupling member is structurally flexible such that each magnet of said plurality of magnets is positionable relative to each other magnet of said plurality of magnets to form a non-planar surface.

2. The attachment assembly of claim 1, wherein said attachment member comprises a belt configured to be worn by an object attached to said attachment member, wherein said belt is disposed inside said sleeve portion.

3. The attachment assembly of claim 1, wherein said attachment member further comprises a first side portion having said first side and a second side portion having said second side opposite said first side portion cooperating with said first side portion in fixing said attachment member to an object.

4. The attachment assembly of claim 3, wherein said first side portion and said second side portion cooperate to fix said attachment member to a belt.

5. The attachment assembly of claim 1, wherein said substantially planar body comprises a flexible body.

6. The attachment assembly of claim 1, wherein said main portion extends below said attachment member.

7. The attachment assembly of claim 1, wherein said at least one holding space comprises a plurality of holding spaces defined by said outer portion coupled to said main portion at three or more separate locations of said main portion.

8. The attachment assembly of claim 7, wherein at least one holding space of said plurality of holding spaces comprises a pocket having an open upper end and a closed lower end.

9. The attachment assembly of claim 7, wherein at least one holding space of said plurality of holding spaces comprises a loop having an open upper end and an open lower end.

10. The attachment assembly of claim 1, wherein said plurality of magnets in at least one of said first coupling member and said second coupling member is arranged in a varied polarity array such that at least two magnets in said array are positioned with reversed polarity relative to each other.

11. The attachment assembly of claim 1, wherein the non-planar surface is formed by each magnet of said plurality of magnets being split from each other magnet of said plurality of magnets.

12. The attachment assembly of claim 11, wherein each magnet of said plurality of magnets is arranged in a varied polarity array such that two magnets that are positionable to form a non-planar surface are positioned in said array with reversed polarity relative to the other.

13. An attachment assembly, comprising:

a removable member and an attachment member;

said removable member comprising a first coupling member comprising a first plurality of magnets positioned in a first array having at least one first magnet in a first polarity configuration and at least one second magnet in a second polarity configuration; and said attachment member comprising a sleeve portion having an outer side and an inner side opposite said outer side such that said inner side is configured to face an object attached to said attachment member, said sleeve portion further comprising a second coupling member comprising a second plurality of magnets positioned in a second array having at least one third magnet in a second polarity configuration and at least one fourth magnet in a first polarity configuration such that each of said first plurality of magnets positioned in said first array are attracted to each correspondingly positioned magnet of said second plurality of magnets positioned in said second array, wherein said first plurality of magnets and said second plurality of magnets are structurally flexible such that each magnet of said first plurality of magnets and each magnet of said second plurality of magnets is positionable relative to each other magnet of said first plurality of magnets or said second plurality of magnets to form respective non-planar surfaces.

14. The attachment assembly of claim 13, wherein said first coupling member is disposed at said inner side of said removable member.

15. The attachment assembly of claim 14, wherein said second coupling member is disposed at said outer side of said attachment assembly.

16. The attachment assembly of claim 13, wherein said attachment assembly comprises a belt configured to be worn by an object attached to said attachment member.

17. The attachment assembly of claim 16, wherein said sleeve portion includes an open first end and an open second end for fixing said attachment assembly to said belt.

18. The attachment assembly of claim 13, wherein said removable member comprises a main portion and an upper portion, said main portion having a substantially planar body and at least one holding space defined by an outer portion coupled to said main portion at two or more separate locations of said main portion.

19. The attachment assembly of claim 18, wherein said main portion comprises at least two holding spaces defined by said outer portion coupled to said main portion at three or more separate locations of said main portion.

20. An attachment assembly, comprising:

a holding member and an attachment member, wherein said holding member comprises a main portion and an upper portion, said main portion having a substantially planar body and at least one holding space defined by an outer portion coupled to said main portion at two or more separate locations of said main portion, and said upper portion having a first coupling member, wherein said attachment member comprises a belt configured to be worn by an object attached to said attachment member and a sleeve portion disposed around said belt, said sleeve portion having a first side and a second side opposite said first side such that said second side is configured to face an object attached to said attachment member, said sleeve portion further comprising a second coupling member, wherein at least one of said first coupling member and said second coupling member comprises a ferromagnetic material such that said first coupling member magnetically couples to said second coupling member, and wherein said ferromagnetic material comprises a structurally flexible plurality of magnets such that each magnet of said plurality of magnets is positionable to form a non-planar surface.

* * * * *